US008319692B2

(12) United States Patent
Chiang et al.

(10) Patent No.: US 8,319,692 B2
(45) **Date of Patent: *Nov. 27, 2012**

(54) CAVITY ANTENNA FOR AN ELECTRONIC DEVICE

(75) Inventors: Bing Chiang, Cupertino, CA (US); Gregory A. Springer, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/344,442

(22) Filed: Jan. 5, 2012

(65) Prior Publication Data

US 2012/0105294 A1 May 3, 2012

Related U.S. Application Data

(63) Continuation of application No. 12/401,599, filed on Mar. 10, 2009, now Pat. No. 8,102,321.

(51) Int. Cl.
*H01Q 1/24* (2006.01)

(52) U.S. Cl. ..... 343/702; 343/898

(58) Field of Classification Search ..... 343/702, 343/767, 898, 700 MS

See application file for complete search history.

(56) References Cited

U.S. PATENT DOCUMENTS

| | | | | |
|---|---|---|---|---|
| 3,573,834 | A | 4/1971 | McCabe et al. | |
| 4,733,245 | A | 3/1988 | Mussler | |
| H1219 | H * | 8/1993 | Miller | 343/708 |
| 5,461,393 | A | 10/1995 | Gordon | |
| 5,703,600 | A | 12/1997 | Burrell et al. | |
| 6,081,729 | A | 6/2000 | Bauerschmidt et al. | |
| 6,127,987 | A | 10/2000 | Maruyama et al. | |
| 6,225,959 | B1 | 5/2001 | Gordon | |
| 6,339,400 | B1 | 1/2002 | Flint et al. | |
| 6,380,930 | B1 | 4/2002 | Van Ruyumbeke | |
| 6,538,618 | B2 * | 3/2003 | Yamamoto et al. | 343/789 |
| 6,621,466 | B2 | 9/2003 | Kuck | |
| 6,646,605 | B2 | 11/2003 | McKinzie et al. | |
| 6,680,712 | B2 * | 1/2004 | Yamamoto et al. | 343/789 |

(Continued)

FOREIGN PATENT DOCUMENTS

CN 1256802 A 6/2000

(Continued)

OTHER PUBLICATIONS

Shiu et al., U.S. Appl. No. 13/221,554, filed Aug. 30, 2011.

(Continued)

*Primary Examiner* — Hoanganh Le

(74) *Attorney, Agent, or Firm* — Treyz Law Group; G. Victor Treyz; David C. Kellogg

(57) ABSTRACT

A cavity antenna for an electronic device such as a portable computer is provided. The antenna may be formed from a conductive cavity and an antenna probe that serves as an antenna feed. The conductive cavity may have the shape of a folded rectangular cavity. A dielectric support structure may be used in forming the antenna cavity. A fin may protrude from one end of the dielectric support structure. The antenna probe may be formed from conductive structures mounted on the fin. An inverted-F antenna configuration or other antenna configuration may be used in forming the antenna probe. The electronic device may have a housing with conductive walls. When the cavity antenna mounted within an electronic device, a planar rectangular end face of the fin may protrude through a thin rectangular opening in the conductive walls to allow the antenna to operate without being blocked by the housing.

16 Claims, 12 Drawing Sheets

U.S. PATENT DOCUMENTS

| | | | | |
|---|---|---|---|---|
| 6,831,607 | B2 | 12/2004 | Hebron et al. | |
| 6,850,205 | B2 * | 2/2005 | Yamamoto et al. | 343/772 |
| 6,859,186 | B2 | 2/2005 | Lizalek et al. | |
| 6,894,650 | B2 | 5/2005 | Darden et al. | |
| 7,126,553 | B1 | 10/2006 | Fink et al. | |
| 7,345,634 | B2 | 3/2008 | Ozkar et al. | |
| 7,486,242 | B2 | 2/2009 | Gala Gala et al. | |
| 7,629,930 | B2 | 12/2009 | Murch et al. | |
| 7,688,276 | B2 | 3/2010 | Quintero Illera et al. | |
| 7,804,453 | B2 | 9/2010 | Chiang et al. | |
| 8,054,232 | B2 | 11/2011 | Chiang et al. | |
| 2002/0135522 | A1 * | 9/2002 | Yamamoto et al. | 343/702 |
| 2002/0149523 | A1 | 10/2002 | Fang et al. | |
| 2004/0051670 | A1 | 3/2004 | Sato | |
| 2004/0075611 | A1 | 4/2004 | Kenoun et al. | |
| 2006/0244663 | A1 | 11/2006 | Fleck et al. | |
| 2007/0057855 | A1 | 3/2007 | Mizoguchi et al. | |
| 2007/0069970 | A1 * | 3/2007 | Argaman et al. | 343/840 |
| 2007/0115187 | A1 | 5/2007 | Zhang et al. | |
| 2007/0120740 | A1 | 5/2007 | Iellici et al. | |
| 2007/0216594 | A1 | 9/2007 | Uno et al. | |
| 2008/0018551 | A1 | 1/2008 | Cheng et al. | |
| 2008/0129625 | A1 * | 6/2008 | Svensson et al. | 343/767 |
| 2009/0153412 | A1 | 6/2009 | Chiang et al. | |
| 2009/0262029 | A1 | 10/2009 | Chiang et al. | |
| 2010/0060529 | A1 | 3/2010 | Schlub et al. | |
| 2010/0073241 | A1 | 3/2010 | Ayala Vazquez et al. | |
| 2010/0182205 | A1 | 7/2010 | Chiang | |
| 2010/0231481 | A1 | 9/2010 | Chiang et al. | |
| 2010/0321249 | A1 | 12/2010 | Chiang et al. | |
| 2010/0321253 | A1 | 12/2010 | Ayala Vazquez et al. | |
| 2011/0006953 | A1 | 1/2011 | Chiang et al. | |
| 2011/0050508 | A1 | 3/2011 | Guterman et al. | |
| 2011/0050509 | A1 | 3/2011 | Ayala Vazquez et al. | |

FOREIGN PATENT DOCUMENTS

| | | | |
|---|---|---|---|
| CN | 2850006 | Y | 12/2006 |
| EP | 1329979 | A1 | 7/2003 |
| EP | 1329985 | A1 | 7/2003 |
| WO | 99/36988 | | 7/1999 |

OTHER PUBLICATIONS

Shiu et al., U.S. Appl. No. 12/750,660, filed Mar. 30, 2010.
Bevelacqua et al., U.S. Appl. No. 12/750,661, filed Mar. 30, 2010.
Ayala Vazquez et al., U.S. Appl. No. 12/553,944, filed Sep. 3, 2009.
Chiang et al., U.S. Appl. No. 12/500,570, filed Jul. 9, 2009.
Chiang, U.S. Appl. No. 12/356,496, filed Jan. 20, 2009.
Ayala Vazquez et al., U.S. Appl. No. 12/486,496, filed Jun. 17, 2009.
Guterman et al., U.S. Appl. No. 12/553,943, filed Sep. 3, 2009.

* cited by examiner

CAVITY ANTENNA FOR AN ELECTRONIC DEVICE

This application is a continuation of patent application Ser. No. 12/401,599, filed Mar. 10, 2009 now U.S. Pat. No. 8,102,321, which is hereby incorporated by reference herein in its entirety. This application claims the benefit of and claims priority to patent application Ser. No. 12/401,599, filed Mar. 10, 2009.

BACKGROUND

This invention relates to electronic devices and, more particularly, to antennas for electronic devices.

Portable computers and other electronic devices often use wireless communications circuitry. For example, wireless communications circuitry may be used to communicate with local area networks and remote base stations.

Wireless computer communications systems use antennas. It can be difficult to design antennas that perform satisfactorily in electronic devices such as portable computers. It is generally desirable to create efficient antennas. For example, efficient antennas are desirable for portable computers, because efficient antennas help conserve battery power during wireless operations. However, optimum antenna efficiency can be difficult to obtain, because portable computer designs restrict the possible locations for implementing the antennas and require that the antennas be constructed as small light-weight structures. For example, it can be difficult to implement efficient antennas in portable computers that contain conductive housing structures, because the conductive housing structures can block radio-frequency signals and thereby reduce the effectiveness of the antennas.

It would therefore be desirable to be able to provide improved antenna arrangements for electronic devices such as portable computers.

SUMMARY

An antenna for an electronic device such as a portable computer is provided. The antenna may use a cavity-backed configuration in which conductive cavity walls are placed in the vicinity of an antenna feed structure formed from an antenna probe.

A dielectric support structure may be provided for the cavity antenna. The dielectric support structure may have a folded rectangular cavity shape. Conductive sidewalls such as metal sidewalls may be formed over the surface of the folded rectangular support structure to form a conductive cavity for the cavity antenna.

A fin may protrude from one end of the dielectric support structure near an opening in the cavity walls. The fin may be used in forming the antenna probe. An inverted-F configuration may be used in forming the antenna probe. With this type of arrangement, an antenna resonating element arm may be mounted on the fin.

One or more conductive branches may be used to selectively short portions of the antenna resonating element arm to ground. Ground plane structures for the inverted-F antenna may be formed from portions of the conductive cavity walls on the front and back of the fin.

A transmission line such as a coaxial cable may be coupled to the antenna probe at antenna feed terminals. A center conductor in the coaxial cable may pass from the back of the fin to the front of the fin. On the front of the fin, the center conductor may be electrically connected to the antenna resonating element arm of the inverted-F antenna. An outer ground conductor in the coaxial cable can be shorted to the ground plane structures on the rear surface of the fin.

Further features of the invention, its nature and various advantages will be more apparent from the accompanying drawings and the following detailed description of the preferred embodiments.

DETAILED DESCRIPTION

The present invention relates to antenna structures for electronic devices. The antennas may be used to convey wireless signals for suitable communications links. For example, an electronic device antenna may be used to handle communications for a short-range link such as an IEEE 802.11 link (sometimes referred to as WiFi®) or a Bluetooth® link. An electronic device antenna may also handle communications for long-range links such as cellular telephone voice and data links.

Antennas such as these may be used in various electronic devices. For example, an antenna may be used in an electronic device such as a handheld computer, a miniature or wearable device, a portable computer, a desktop computer, a router, an access point, a backup storage device with wireless communications capabilities, a mobile telephone, a music player, a remote control, a global positioning system device, devices that combine the functions of one or more of these devices and other suitable devices, or any other electronic device. With one suitable arrangement, which is sometimes described herein as an example, the electronic devices in which the antennas are provided may be portable computers such as laptop (notebook) computers. This is, however, merely illustrative. Antennas may, in general, be provided in any suitable electronic device.

Figure 1:
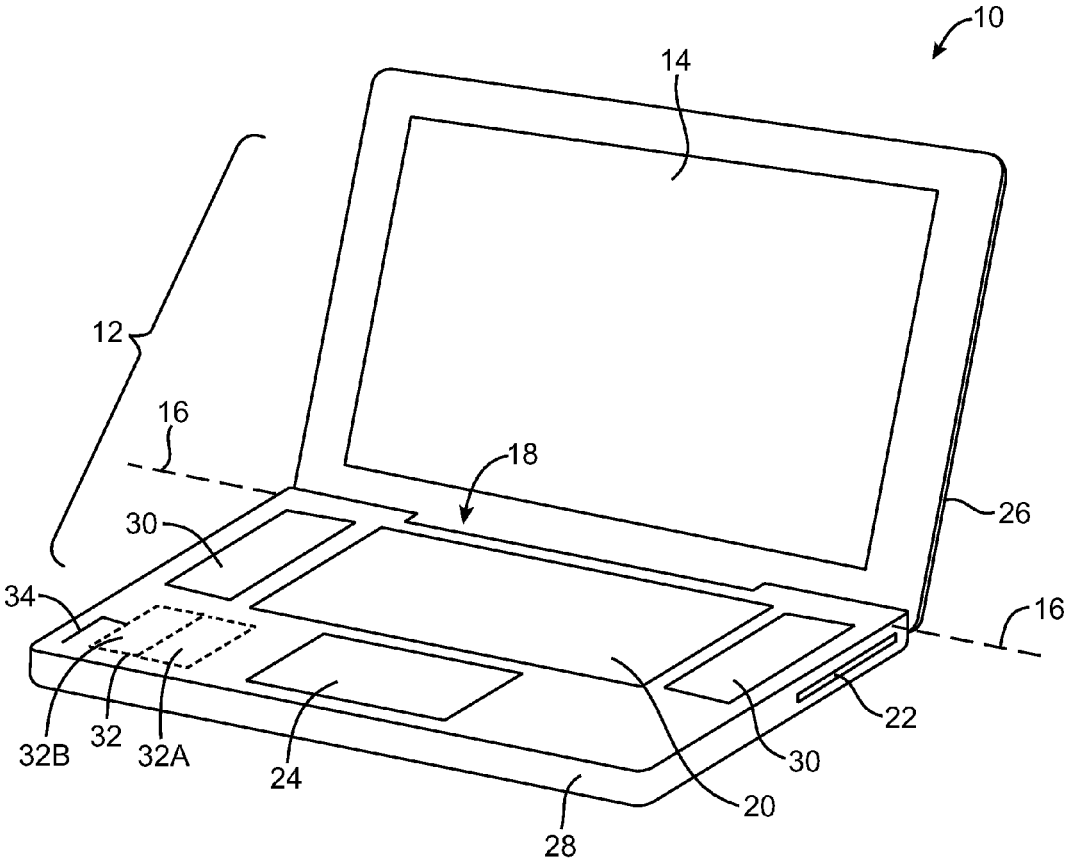
FIG. 1 is a perspective view of an illustrative electronic device such as a portable computer in which an antenna may be implemented in accordance with an embodiment of the present invention.

An illustrative electronic device such as a portable computer in which an antenna may be provided is shown in FIG. 1. As shown in FIG. 1, portable computer 10 may have a housing 12. Housing 12, which is sometimes referred to as a case, may be formed from one or more individual structures. For example, housing 12 may have a main structural support member that is formed from a solid block of machined aluminum or other suitable metal. Multipart housings may be used in which two or more individual housing structures are combined to form housing 12. The structures in housing 12 may include internal frame members, external coverings such as sheets of metal, etc. Housing 12 and its associated components may, in general, be formed from any suitable materials such as such as plastic, ceramics, metal, glass, etc. An advantage of forming housing 12 at least partly from metal is that metal is durable and attractive in appearance. Metals such as aluminum may be anodized to form an insulating oxide coating.

Case 12 may have an upper portion 26 and a lower portion 28. Lower portion 28 may be referred to as the base unit housing or main unit of computer 10 and may contain components such as a hard disk drive, battery, and main logic board. Upper portion 26, which is sometimes referred to as a cover or lid, may rotate relative to lower portion 28 about rotational axis 16. Portion 18 of computer 10 may contain a hinge and associated clutch structures and may sometimes be referred to as a clutch barrel.

Lower housing portion 28 may have an opening such as slot 22 through which optical disks may be loaded into an optical disk drive. Lower housing portion 28 may also have touchpad 24, keys 20, and other input-output components. Touch pad 24 may include a touch sensitive surface that allows a user of computer 10 to control computer 10 using touch-based commands (gestures). A portion of touchpad 24 may be depressed by the user when the user desires to "click" on a displayed item on screen 14. If desired, additional components may be mounted to upper and lower housing portions 26 and 28. For example, upper and lower housing portions 26 and 28 may have ports to which cables can be connected (e.g., universal serial bus ports, an Ethernet port, a Firewire port, audio jacks, card slots, etc.). Buttons and other controls may also be mounted to housing 12.

If desired, upper and lower housing portions 26 and 28 may have transparent windows through which light may be emitted from light-emitting diodes. Openings such as perforated speaker openings 30 may also be formed in the surface of housing 12 to allow sound to pass through the walls of the housing.

A display such as display 14 may be mounted within upper housing portion 26. Display 14 may be, for example, a liquid crystal display (LCD), organic light emitting diode (OLED) display, or plasma display (as examples). A glass panel may be mounted in front of display 14. The glass panel may help add structural integrity to computer 10. For example, the glass panel may make upper housing portion 26 more rigid and may protect display 14 from damage due to contact with keys or other structures.

Portable computer 10 may contain circuitry 32. Circuitry 32 may include storage and processing circuitry 32A and input-output circuitry 32B.

Storage and processing circuitry 32A may include one or more different types of storage such as hard disk drive storage, nonvolatile memory (e.g., flash memory or other electrically-programmable-read-only memory), volatile memory (e.g., static or dynamic random-access-memory), etc. Storage and processing circuitry 32A may be used in controlling the operation of computer 10. Processing circuitry in circuitry 32A may be based on processors such as microprocessors, microcontrollers, digital signal processors, dedicated processing circuits, power management circuits, audio and video chips, and other suitable integrated circuits. Storage and processing circuitry 32A may be used to run software on computer 10, such as operating system software, application software, software for implementing control algorithms, communications protocol software etc.

Input-output circuitry 32B may be used to allow data to be supplied to computer 10 and to allow data to be provided from computer 10 to external devices. Examples of input-output devices that may be used in computer 10 include display screens such as touch screens (e.g., liquid crystal displays or organic light-emitting diode displays), buttons, joysticks, click wheels, scrolling wheels, touch pads, key pads, keyboards, microphones, speakers and other devices for creating sound, cameras, sensors, etc. A user can control the operation of computer 10 by supplying commands through these devices or other suitable input-output circuitry 32B. Input-output circuitry 32B may also be used to convey visual or sonic information to the user of computer 10. Input-output circuitry 32B may include connectors for forming data ports (e.g., for attaching external equipment such as accessories, etc.).

Computer 10 may include one or more antennas. For example, computer 10 may include one or more cavity-backed antennas. Computer 10 may also include one or more additional antennas. The antennas in computer 10 may be coupled to wireless communications circuitry (e.g., radio-frequency transceiver circuits) in input-output circuitry 32B using coaxial cables, microstrip transmission lines, or other suitable transmission lines such as transmission line 34.

The antenna structures in computer 10 may be used to handle any suitable communications bands of interest. For example, antennas and wireless communications circuitry in circuitry 32B of computer 10 may be used to handle cellular telephone communications in one or more frequency bands and data communications in one or more communications bands. Typical data communications bands that may be handled by the wireless communications circuitry in computer 10 include the 2.4 GHz band that is sometimes used for Wi-Fi® (IEEE 802.11) and Bluetooth® communications, the 5 GHz band that is sometimes used for Wi-Fi communications, the 1575 MHz Global Positioning System band, and 2G and 3G cellular telephone bands. These bands may be covered using single-band and multiband antennas. For example, cellular telephone communications can be handled using a multiband cellular telephone antenna. A single band antenna may be provided to handle Bluetooth® communications. Computer 10 may, as an example, include a multiband antenna that handles local area network data communications at 2.4 GHz and 5 GHz (e.g., for IEEE 802.11 communications), a single band antenna that handles 2.4 GHz IEEE 802.11 communications and/or 2.4 GHz Bluetooth® communications, or a single band or multiband antenna that handles other communications frequencies of interest. These are merely examples. Any suitable antenna structures may be used by computer 10 or other electronic device to cover communications bands of interest.

The antennas in computer 10 may be implemented using any suitable antenna configuration. For example, an antenna for computer 10 may be implemented as a cavity antenna, a monopole antenna, a dipole antenna, a patch antenna, an inverted-F antenna, an L-shaped antenna, a planar inverted-F antenna (PIFA), a slot antenna, a helical antenna, a hybrid antenna including two or more of these antenna structures, or any other suitable antenna structures.

With one suitable arrangement, which is described herein as an example, at least one of the antennas used in computer 10 is implemented using a cavity antenna arrangement. With this type of configuration, a conductive cavity is formed from conductive materials such as metal. An antenna probe structure is formed adjacent to an opening in the antenna cavity. The antenna probe structure may be coupled to a transmission line such as a coaxial cable. During operation, the antenna probe may excite the cavity antenna and thereby serve as a feed for the antenna.

The cavity may have cavity walls. The cavity walls may be formed by conductive structures such as housing structures or may be formed from metal layers or other conductive layers that are supported by a dielectric support structure. The dielectric support structure may be formed from a dielectric such as fiberglass-filled epoxy or fiberglass-filled polyarylamide. Other dielectrics may also be used if desired.

The cavity may be folded along its length so that the cavity may be mounted within a relatively confined space such as the interior of housing 12 without excessively decreasing its length. The fold in the cavity may have any suitable shape. For example, the fold may form a 180° bend in the cavity.

A thinned portion of the dielectric support structure may form a fin-shaped protrusion. The fin may be used for supporting portions of the antenna probe. The fin may also be used to help the antenna convey radio-frequency signals through a gap in housing 12 or other conductive device structures. The fin may have a thin profile that allows the antenna to be used in devices with correspondingly thin gaps. For example, the fin may have a thickness of about 0.2 mm, which allows the antenna to be used in devices with conductive housings having gaps (i.e., slot-shaped surface openings) of about 0.2 mm. The length of this type of opening and the corresponding lateral dimension of the fin of the antenna may be, for example, about 60 mm (as an example).

Figure 2:
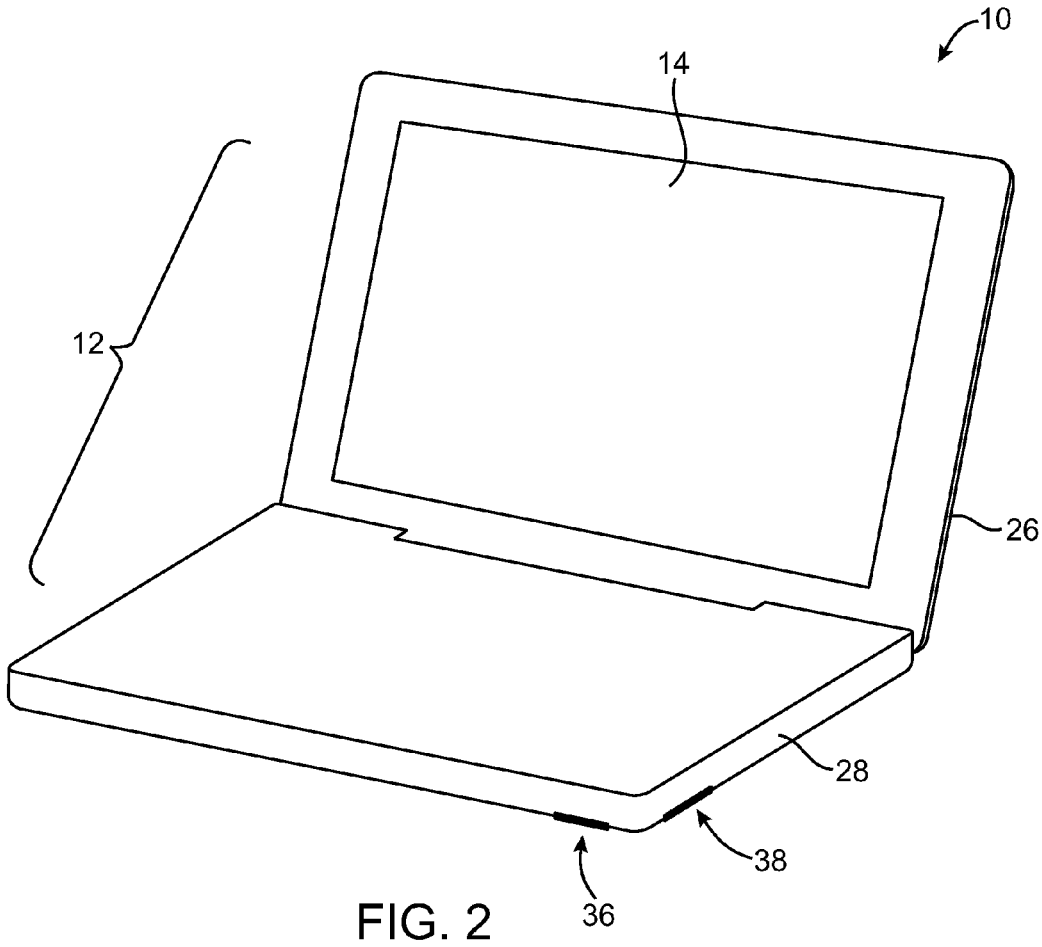
FIG. 2 is a perspective view of an illustrative electronic device such as a portable computer showing where antennas may be located in accordance with an embodiment of the present invention.

Because the antenna can be used to convey signals in and out of a housing that has a gap of only about 0.2 mm (as an example), the antenna can be used in portions of electronic device 10 in which larger and more visible structures would not be acceptable. In general, the antenna may be used to convey signals through any suitable opening in housing 12. Examples of gaps in which the antenna may be used include gaps formed between mating housing portions (e.g., a lid and base, a cover and lid, a cover and base, etc.) and gaps in a single housing portion (e.g., a gap formed in a lid, a gap formed in a base housing structure, a gap formed in a housing sidewall, etc.). Illustrative locations at which gaps such as these may be formed in housing 12 of electronic device 10 and which may therefore serve as suitable locations for mounting the cavity antenna include lower edge locations such as locations 36 and 38 in FIG. 2.

Figure 3:
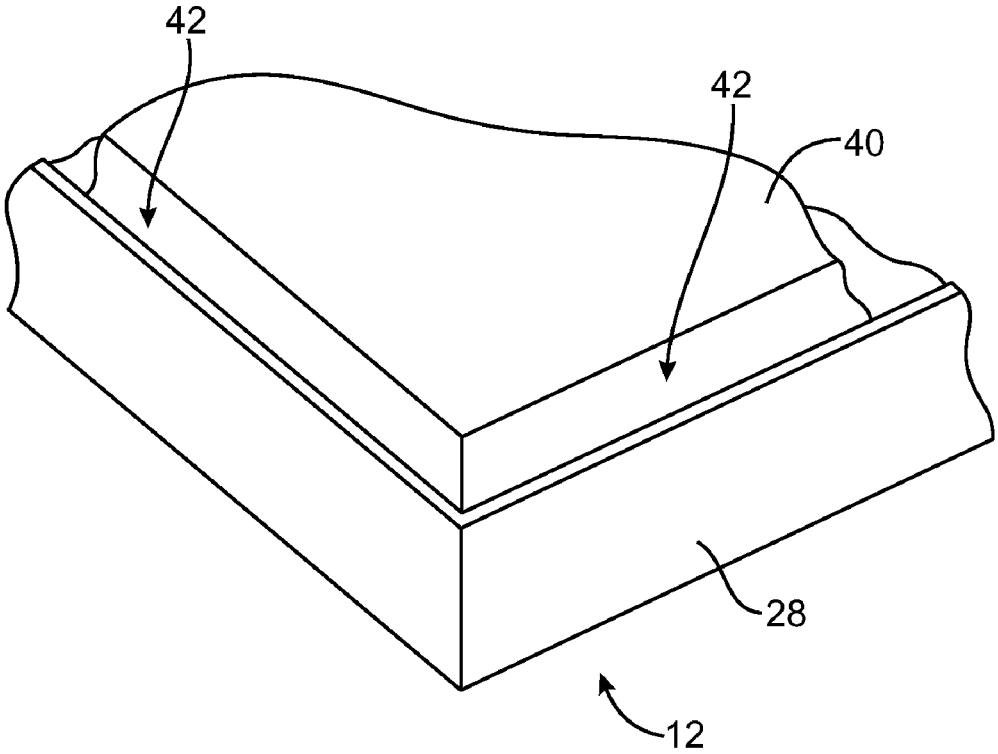
FIG. 3 is a perspective view of an interior portion of an electronic device such as a portable computer showing gaps that may be provided to space internal components away from housing walls and that may be used to house antennas in accordance with an embodiment of the present invention.

Electronic device 10 may include a battery and other internal components. Electrical components in the interior of housing 12 may sometimes be intentionally spaced by a certain distance from the interior surfaces of housing walls in housing 12. This helps the structures of device 10 to survive sharp impacts of the type that may arise if a user inadvertently drops the electronic device to the ground. As shown in FIG. 3, for example, device 10 may have gaps such as gaps 42 between housing portion 28 of housing 12 and component 40. Component 40 may be, for example, a battery or other electrical component within the interior of device 10. Gaps 42 may prevent damage to battery 40 upon impact. At least some of the space provided by gaps 42 may, if desired, be used to house antenna 44.

Figure 4:
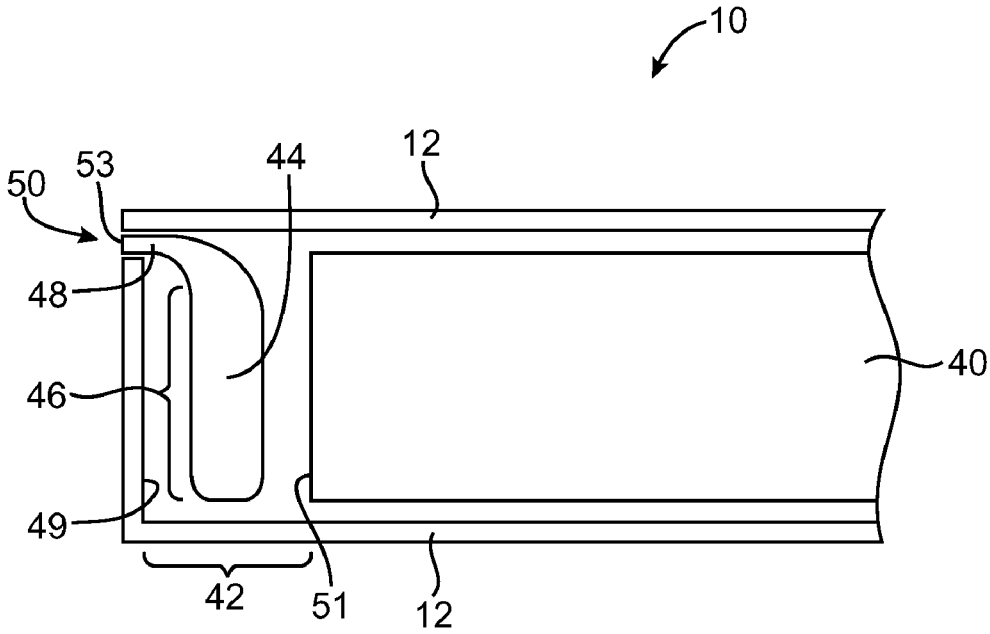
FIG. 4 is a cross-sectional side view of an illustrative electronic device such as a portable computer showing how an antenna that is located between an internal component such as a battery and a conducive housing wall may have a thin portion such as a dielectric fin that is used to convey electromagnetic signals through a gap in the conductive housing in accordance with an embodiment of the present invention.

As shown in FIG. 4, for example, antenna 44 may be mounted within opening 42 between interior surface 49 of the wall of housing 12 and surface 51 of battery 40. Antenna 44 may have a fin portion such as fin 48 mounted to a larger body portion such as body 46. The end of fin 48 may form a flat planar region such as planar fin end surface 53 (as an example). When mounted as shown in FIG. 4, fin 48 may extend from the interior of device 10 and housing 12 to the exterior of device 10 and housing 12 through opening 50. If desired, front face 53 of fin 48 may lie flush with the exterior surface of housing 12. As shown in FIG. 4, antenna 44 may have curved portions that are located between interior surface 49 of the wall of housing 12 and surface 51 of battery 40. The curved portions of antenna 44 may include, as shown in FIG. 4, a first curved portion having a first bend radius (e.g., the curved portion closest to interior surface 49 of the wall of housing 12 in FIG. 4) and a second curved portion having a second and larger bend radius (e.g., the curved portion closes to surface 51 of battery 40 in FIG. 4).

Figure 5:
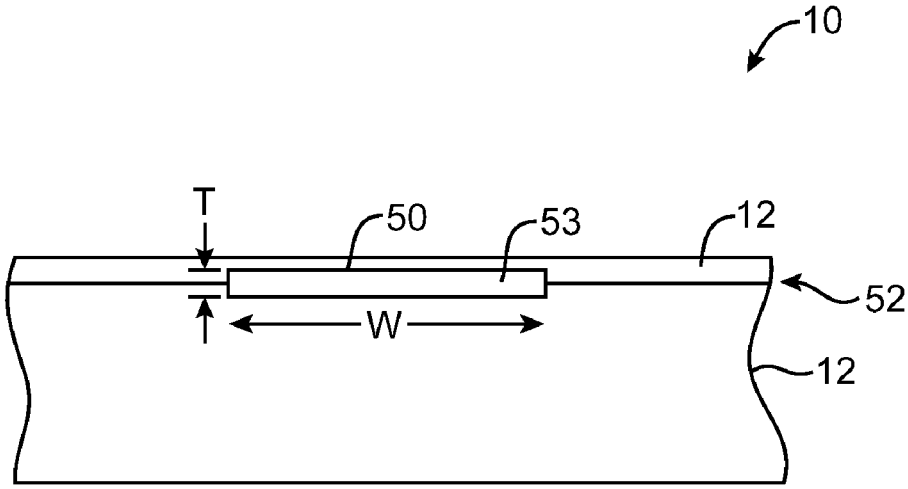
FIG. 5 is a front view of an illustrative portable computer housing showing how an antenna of the type shown in FIG. 4 may have a slot-shaped dielectric face through which electromagnetic signals pass in accordance with an embodiment of the present invention.

A front view of opening 50 from the exterior of device 10 is shown in FIG. 5. As shown in FIG. 5, opening 50 may have a substantially rectangular shape (as an example). The thickness of opening 50 may be relatively thin compared to its width. With this type of arrangement, rectangular planar fin end surface 53 may have one lateral dimension (i.e., thickness T) that is much smaller (e.g., 5 times smaller or more, ten times smaller or more, etc.) than its other lateral dimension (i.e., width W). With one illustrative arrangement, dimension T may be about 0.2 mm and dimension W may be about 60 mm (as an example). In some configurations, such as the portable computer configuration shown in FIG. 1, different portions of housing 12 (e.g., upper housing portion 26 and lower housing portion 28) may be placed in either an open position (as shown in FIG. 1) or a closed position. In the closed position, housing portions 12 may meet along an interface such as interface 52. Interface 52 may include elastomeric gasket structures or other structures that allow fin end portion 53 to protrude through opening 50. If desired, opening 50 may be formed directly through a rigid housing wall. Openings such as opening 50 may also be formed partly from elastomeric gasket structures and partly from openings in rigid housing walls in housing 12. Other arrangements may be used if desired. The illustrative configuration for opening 50 that is shown in FIGS. 4 and 5 is merely illustrative.

Figure 6:
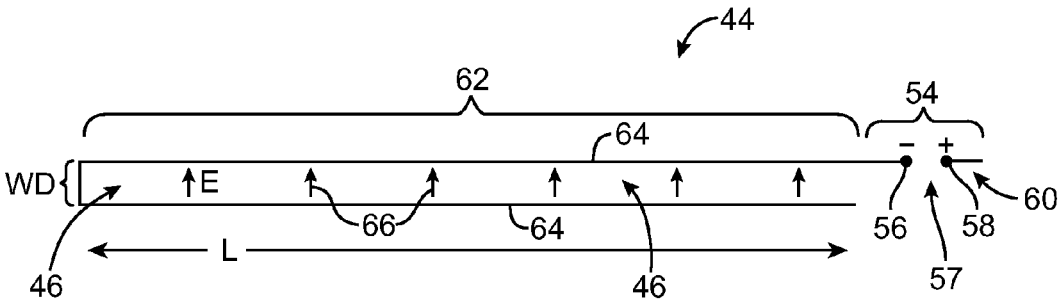
FIG. 6 is a cross-sectional side view of an illustrative antenna having a cavity portion and an antenna probe portion that serves as an antenna feed for the antenna in accordance with an embodiment of the present invention.

As shown in FIG. 6, antenna 44 may have a cavity portion such as cavity 62 and a probe portion such as probe 54. Probe 54 may have antenna feed terminals such as positive antenna feed terminal 58 and ground antenna feed terminal 56 and may serve as an antenna feed for antenna 44. Cavity 62 may be formed from conductive cavity walls such as walls 64. Walls 64 and the conductive structures of probe 54 may be formed from conductive materials such as metal. In device 10, a coaxial cable or other transmission line 34 may have positive and ground lines that are respectively connected to antenna feed terminals 58 and 56. During operation, when antenna 44 is transmitting and receiving radio-frequency antenna signals, the electric field component of the antenna signals may be oriented as shown by electric field polarization vectors 66 of FIG. 6 (i.e., with the electric field E oriented transversely across the interior width WD of cavity 62, perpendicular to its longer dimension, length L).

Cavity 62 may have conductive members such as walls 64 formed on a dielectric support that forms the shape of antenna body 46 (FIG. 4). Antenna probe 54 may be used to excite cavity 62 and thereby couple transmission line 34 (FIG. 1) to antenna 44. Any suitable antenna structure may be used for probe 54. With one suitable arrangement, which is sometimes described herein as an example, antenna probe 54 is formed from an inverted-F antenna structure. As shown in FIG. 6, this type of antenna probe may have an antenna resonating element 60 that is separated by gap 57 from cavity wall 64. Positive antenna feed terminal 58 may be electrically connected to antenna resonating element 60 and ground antenna feed terminal 56 may be electrically connected to conductive antenna wall 64. In this context, the portions of wall 64 that are separated from antenna resonating element 60 by gap 57 serve as a ground element for the inverted-F antenna structure formed from antenna resonating element 60.

Probe 54 may, if desired, have other configurations. For example, additional conductive members may be placed in the vicinity of antenna resonating element 60 to serve as additional ground structures for probe 54. Moreover, other antenna designs may be used for probe 54. The use of an inverted-F antenna structure for antenna probe 54 of antenna 44 is merely illustrative.

Figure 7:
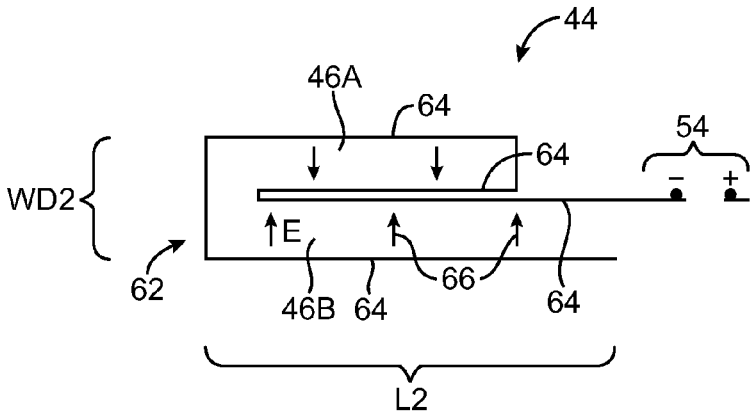
FIG. 7 is a cross-sectional side view of an antenna of the type shown in FIG. 6 in which the cavity portion of the antenna has been folded to conserve space in accordance with an embodiment of the present invention.

As shown in FIG. 7, cavity 62 may be folded back on itself or otherwise configured to make antenna 44 more compact while maintaining a given cavity length. In the FIG. 7 example, cavity 62 has been folded once with a 180° fold, so that the interior of antenna 44 is formed from body region 46A and parallel body region 46B. Body region 46B is folded back on body region 46A, so that antenna dimension L2 is roughly half of original unfolded cavity length L (FIG. 6), while the overall cavity length L is unchanged. In this type of configuration, dimension WD2 (i.e., the width or thickness of cavity body 46) may increase slightly (i.e., to twice that of width/thickness dimension WD of FIG. 6), but because the length L2 is substantially less than length L of FIG. 6, an antenna with a folded configuration of the type shown in FIG. 7 will sometimes be more capable of fitting within relatively confined housing locations than an antenna with an unfolded configuration of the type shown in FIG. 7. Configurations with cavities that have more folds or that have folds with different angles may also be used. The example of FIG. 7 in which cavity 62 has been provided with a single 180° fold is merely illustrative.

Figure 8:
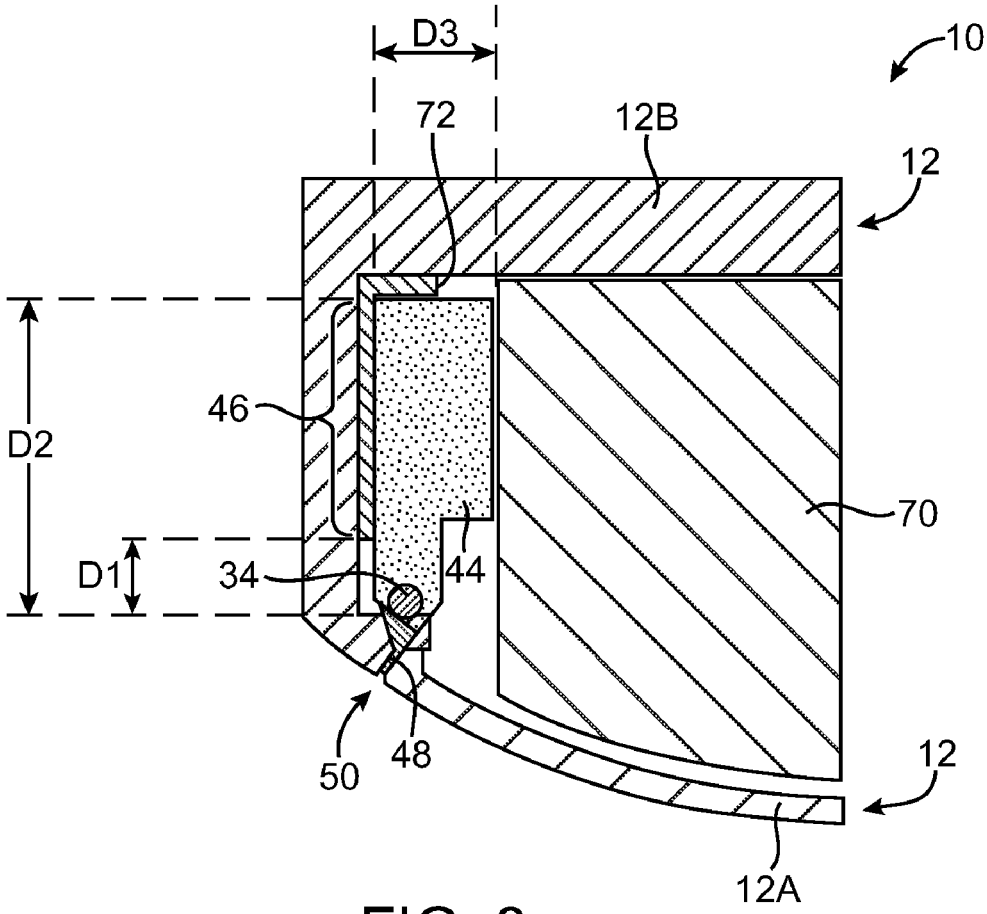
FIG. 8 is cross-sectional side view of an illustrative antenna of the type shown in FIG. 7 in which the antenna has a thin dielectric fin portion that serves to convey radio-frequency signals through a gap in a conductive housing in accordance with an embodiment of the present invention.

A cross-sectional side view of an illustrative folded cavity antenna such as antenna 44 of FIG. 7 that has been mounted within housing 12 of device 10 is shown in FIG. 8. As shown in FIG. 8, antenna 44 may be fed by a transmission line 34 such as a coaxial cable. Fin portion 48 of antenna 44 may pass through opening 50 in housing 12. In the example of FIG. 8, housing 12 is formed from housing portions 12A and 12B. Housing portion 12A may be, for example, a cover portion that covers interior components 70 such as battery 40 of FIG. 3 within the interior of device 10. Housing portion 12B may be, for example, a main housing unit. Antenna 44 may be mounted to interior surfaces of housing portion 12B using adhesive 72 or other suitable mounting structures. Body 46 may have a folded configuration of the type described in connection with FIG. 7. In this type of configuration, dimension D1 may be about 2.5 mm, dimension D2 may be about 7 mm, and dimension D3 may be about 1.5 mm, which helps make antenna 44 compact and able to fit.

Figure 9:
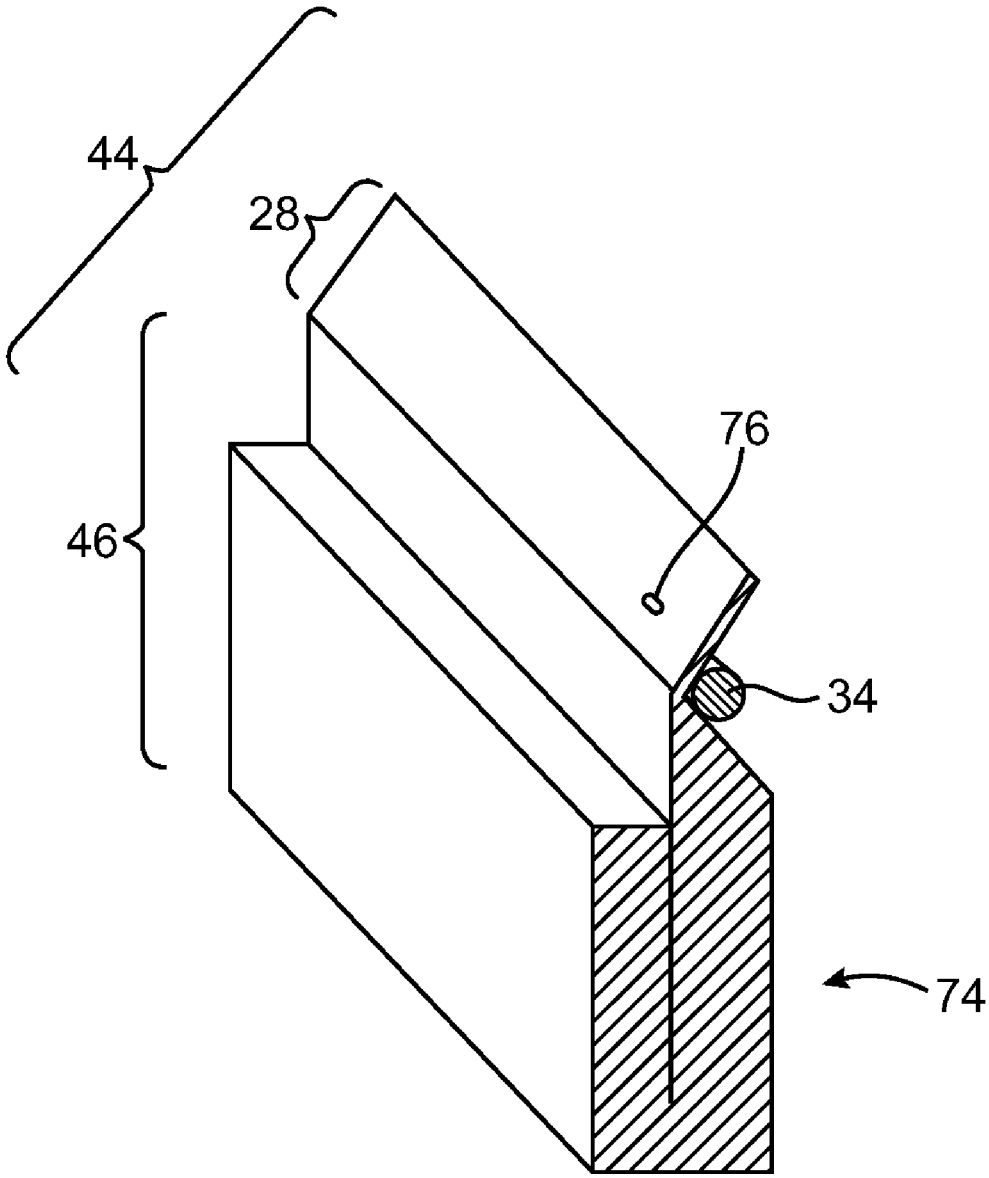
FIG. 9 is a perspective view of dielectric support structure portions of an antenna of the type shown in FIG. 8 in accordance with an embodiment of the present invention.

Cavity antenna 44 may be implemented by forming conductive cavity walls over a dielectric support structure. An illustrative dielectric support structure for antenna 44 is shown in the perspective view of FIG. 9. As shown in FIG. 9, dielectric support structure 74 may have a portion that forms fin 28 and a portion that forms body 46 for antenna 44. (The conductive portions of antenna 44 are not shown in FIG. 9.) Coaxial cable 34 may be cradled along a recessed portion in the rear of dielectric support structure 74. Cable 34 may have a conductive outer braid conductor and a center conductor or other suitable conductive lines. The outer conductor may serve as a ground conductor and may be coupled to planar ground structures in antenna 44 such as portions of conductive cavity sidewalls using a conductive ground terminal such as terminal 56 of FIG. 6. The center conductor may serve as a positive transmission line conductor and may be coupled to antenna terminal 58 (FIG. 6). Terminal 58 may, for example, be formed on the front side of antenna fin 28. A conductive member such as pin 76 may be used to route the center conductor of cable 34 on the back side of fin 28 to positive antenna terminal 58 and associated resonating element structures on the front side of fin 28.

Figure 10:
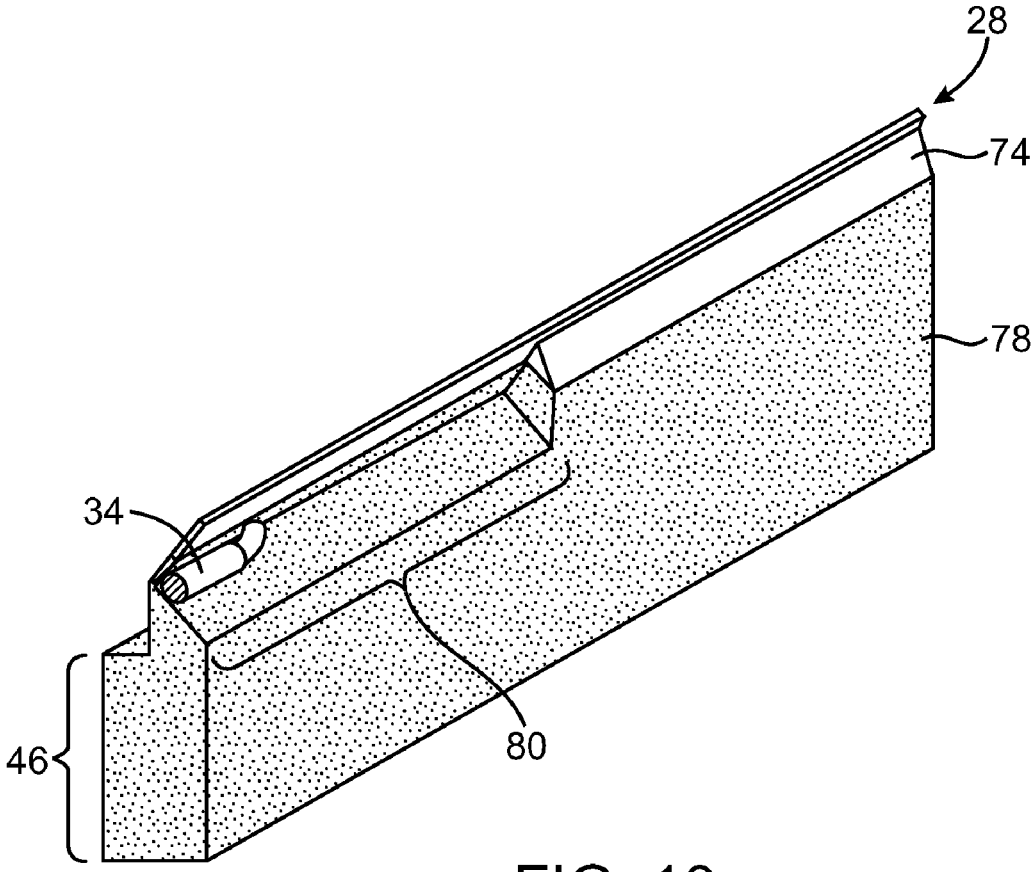
FIG. 10 is a rear perspective view of an antenna of the type shown in FIG. 8 in which inner dielectric support structures have been covered with a conductive material such as metal to form the antenna cavity and antenna probe in accordance with an embodiment of the present invention.

FIG. 10 is a perspective view of antenna 44 of FIG. 9 as viewed from the rear of dielectric support structure 74. As shown in FIG. 10, support structure 74 may be covered with conductive structures 78 such as metal layers. The metal layers may include patterned copper traces or other metal structures. These metal structure may include planar metal regions (e.g., for the sidewalls of the antenna cavity) and narrower lines (e.g., for forming portions of probe 54 (FIG. 6). Portion 80 of dielectric support structure 74 may be recessed to accommodate coaxial cable 34.

Dielectric support structure 74 may be formed from any suitable dielectric such as fiberglass-filled epoxy or fiberglass-filled polyarylamide. If desired, materials such as flexible printed circuit board materials (e.g., polyimide) and rigid printed circuit board materials (e.g., fiberglass-filled epoxy) may be used in the cavity antenna.

An advantage of using a solid dielectric in forming some or all of dielectric support structure 74 is that this type of arrangement may help prevent intrusion of dust, liquids, or other foreign matter into portions of antenna cavity 62. Dielectric in cavity 62 may also be used as a structural support that physically helps hold cavity walls 64 and other conductive antenna structures in place. Dielectric materials are transparent to radio-frequency signals, so dielectric materials may be used in portions of cavity antenna 44 where it is desired not to block radio-frequency signals.

In general, any suitable dielectric material can be used to form dielectric cavity antenna structures for computer 10. Dielectric structures that surround or are located within the cavity of a cavity antenna may be formed from a completely solid dielectric, a porous dielectric, a foam dielectric, a gelatinous dielectric (e.g., a coagulated or viscous liquid), a dielectric with grooves or pores, a dielectric having a honeycombed or lattice structure, a dielectric having spherical voids or other voids, a combination of such non-gaseous dielectrics, etc. Hollow features in solid dielectrics may be filled with air or other gases or lower dielectric constant materials. Examples of dielectric materials that may be used in a cavity antenna and that contain voids include epoxy with gas bubbles, epoxy with hollow or low-dielectric-constant microspheres or other void-forming structures, polyimide with gas bubbles or microspheres, etc. Porous dielectric materials used in a cavity antenna in device 10 can be formed with a closed cell structure (e.g., with isolated voids) or with an open cell structure (e.g., a fibrous structure with interconnected voids). Foams such as foaming glues (e.g., polyurethane adhesive), pieces of expanded polystyrene foam, extruded polystyrene foam, foam rubber, or other manufactured foams can also be used in a cavity antenna in device 10. If desired, the dielectric antenna materials can include layers or mixtures of different substances such as mixtures including small bodies of lower density material.

The conductive antenna elements that form the sidewalls and other portions of a cavity antenna may be formed from conductive portions of housing 12, conductive sheets such as planar metal sheets, wires, traces on rigid printed circuit boards or flex circuit substrates, stamped metal foil patterns, milled or cast metal parts, or any other suitable conductive structures.

Any suitable fabrication techniques may be used in forming an antenna having conductive structures such as these. For example, certain surface regions of dielectric support structure 74 may be selectively activated for subsequent metal plating operations using light (e.g., using laser light). With this type of approach, metal will only adhere to dielectric support structure 74 during electroplating operations in the surface regions that were exposed to the laser light. Unexposed portions of dielectric support structure 74 will remain uncovered with metal. Light deactivation schemes may also be used where metal adheres to only those portions of dielectric that have not been exposed to light.

With another suitable arrangement, plastic for dielectric support structure 74 is molded using a so-called double-shot technique. One portion of the dielectric (the first "shot") is injected to form a first part of the support, followed by injection of a second dielectric shot to form a second part of the support. Because of the different metal adhering qualities of the first and second shots, metal will only adhere to one of the two shots during electroplating operation (e.g., to the second shot portions).

Dielectric support structure 74 can also be provided with patterned metal layers by coating all or some of dielectric support structure 74 with metal and ablating undesired portions of the coating. Ablation operations may be implemented using a pulsed laser (as an example).

In another illustrative arrangement, masking techniques are used to pattern conductive structures on dielectric support structure 74. As an example, dielectric support structure 74 can be coated with a layer of metal. The metal layer can then be coated with a layer of photoresist, which is exposed and developed in a desired pattern (e.g., using a photomask or directed laser light). Unprotected metal surfaces can then be removed by etching. Tape and other substances can also be used as mask layers. If desired, patterned conductors for antenna 44 can be formed using conductive ink.

Figure 11:
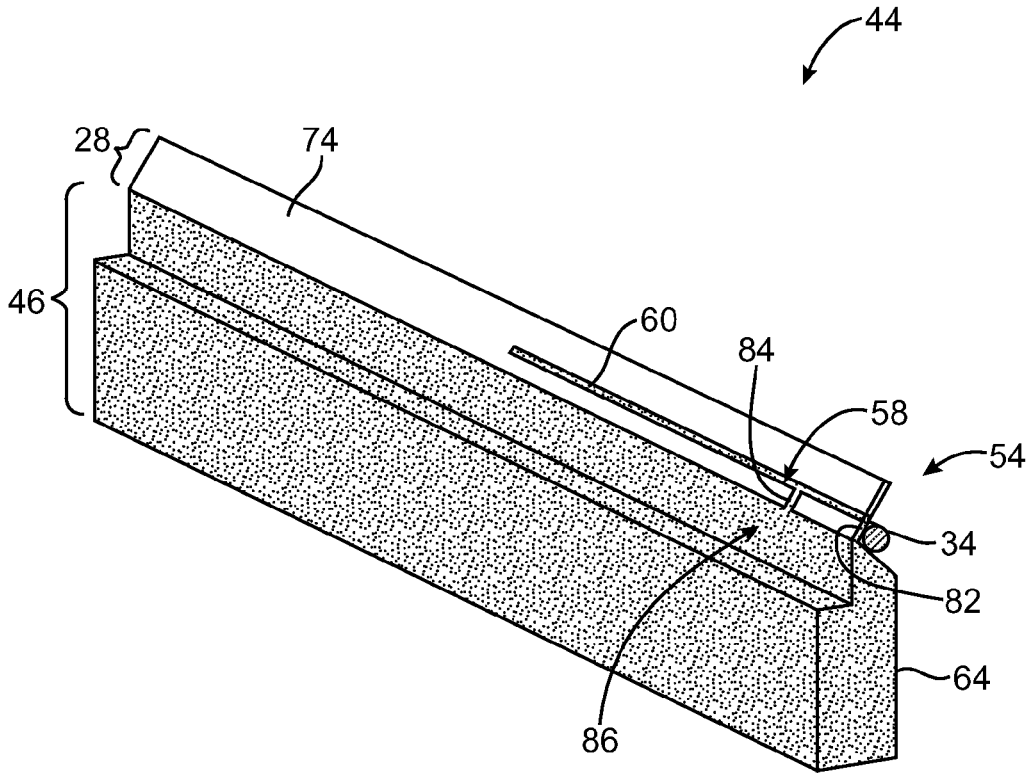
FIG. 11 is a front perspective view of an antenna of the type shown in FIG. 8 in which inner dielectric support structures have been covered with a conductive material such as metal to form the antenna cavity and antenna probe in accordance with an embodiment of the present invention.

Illustrative conductive structures that may be formed on dielectric support structure 74 are shown in FIG. 11. In the example of FIG. 11, conductive traces have been formed on dielectric support structure 74 that form an inverted-F antenna (probe 54). Probe 54 of FIG. 11 is formed from inverted-F antenna resonating element 60. antenna resonating element 60 has a shorting branch 82 at one end of antenna resonating element 60 that shorts antenna resonating element 60 to ground portions 86 of cavity sidewalls 64. Antenna resonating element 60 also has a second branch 84 that shorts the main arm of antenna resonating element 60 to ground structures 86 at an intermediate location along antenna resonating element 60. Positive antenna feed terminal 58 may be connected to antenna resonating element 60 at a location that is to the left of both arms 84 and 82 (in the orientation of FIG. 11). With this type of arrangement, arms 84 and 82 are spaced from antenna terminal 58 at two respective distances along the longitudinal axis of antenna resonating element 60 (i.e., arm 84 is closer to antenna terminal 58 than arm 82). The position of each arm along element 60 contributes a different impedance to antenna 44. These different impedance contributions tend to broaden the bandwidth of the antenna. If desired, other feed positions can be used for probe 54. For example, antenna feed terminal 58 may be located at different locations along arm 60.

Figure 12:
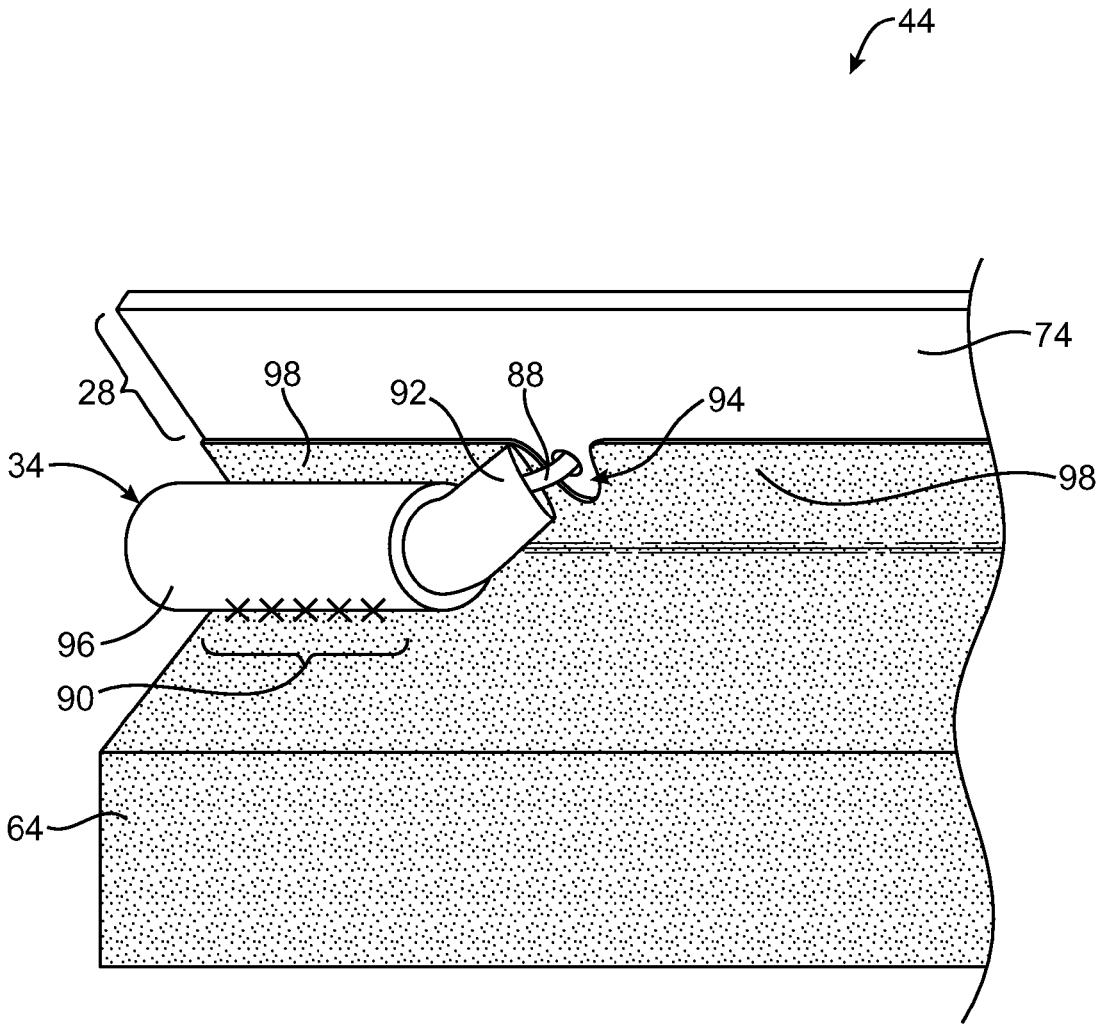
FIG. 12 is a rear view of an antenna of the type shown in FIG. 8 showing how a coaxial cable may have an outer ground conductor connected to a rear ground plane element on the antenna and may have a center conductor that serves as a positive antenna feed and that is routed to the front side of the antenna through a hole in the dielectric fin portion of the antenna in accordance with an embodiment of the present invention.

FIG. 12 is a rear view of antenna 44 showing how coaxial cable 34 may have a center conductor such as center conductor 88 that passes through a hole in dielectric support structure 74 and thereby connects to antenna terminal 58 on the front of fin 28. Center conductor 88 may be surrounded by an insulator such as insulating jacket 92. Outer conductor 96 may be connected to the metal layers on dielectric support structure 74 such as cavity wall metal layers 64 in regions such as region 90 (e.g., using solder, welds, conductive adhesive, conductive paste, etc.). Metal 64 may have a rectangular portion such as rectangular portion 98 that extends up the lower side of fin 28 and forms a secondary portion of the ground for antenna probe 54. Notch 94 in ground plane 98 helps allow center conductor 88 to pass from the rear of antenna 44 to the front of antenna 44 without becoming shorted to antenna cavity walls 64 in portion 98. With this type of configuration, ground plane structures 86 of FIG. 11 forms a first ground plane that is co-planar with antenna probe 54. Ground plane structures 86 are relatively easy to access, which allows the shape and size of front-side ground plane structures 86 to be modified to tune antenna 44 (if desired). Ground plane structures 98 of FIG. 12 form a second ground plane on the opposite side of fin 28. This second ground plane helps to excite the electric field E in fin 28. This field, in turn, excites the field E in cavity (FIG. 7) that is ultimately radiated out of antenna 44 during signal transmission operations.

Figure 13:
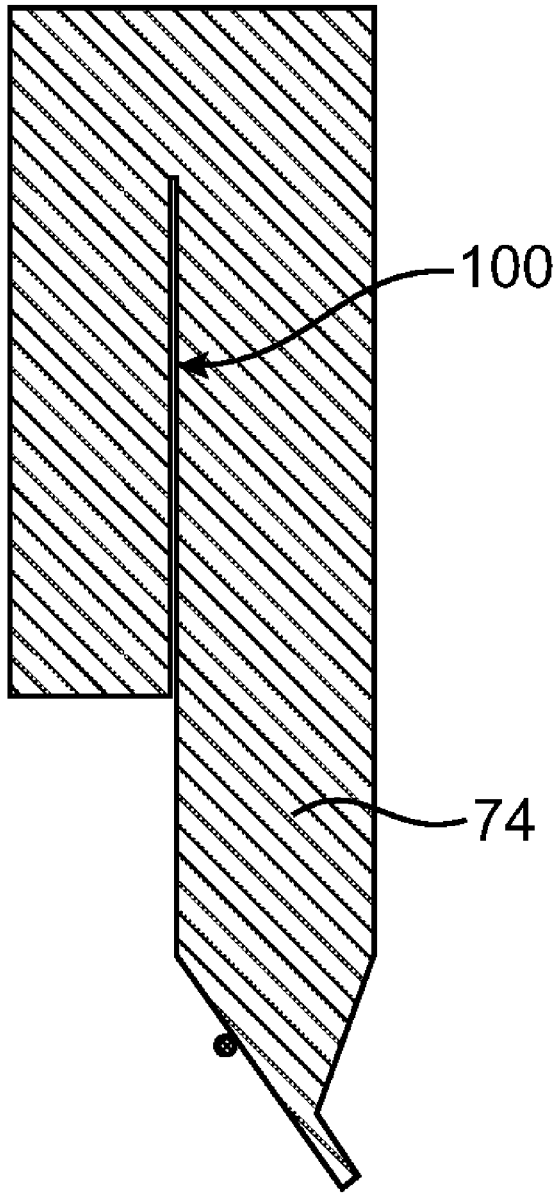
FIG. 13 is a side view of an illustrative dielectric support structure for an antenna with a folded cavity showing how a gap may be formed between folded portions of the dielectric support to accommodate conductive cavity layers in accordance with an embodiment of the present invention.

As shown in the cross-sectional view of FIG. 13, dielectric support structure 74 may include a gap 100 that is filled with conductor to form the sidewalls 64 of cavity 62. Conductor may be formed in gap 100 using any suitable technique (e.g., by inserting a layer of foil in gap 100, by folding an unfolded dielectric support structure 74 that is coated with foil or plated metal layers, etc.).

The foregoing is merely illustrative of the principles of this invention and various modifications can be made by those skilled in the art without departing from the scope and spirit of the invention.

What is claimed is:

1. An electronic device, comprising:

a conductive housing;

at least one internal component within the conductive housing; and a cavity antenna having an antenna cavity with conductive walls and an antenna resonating element, wherein the antenna cavity has curved portions that are located between the at least one internal component and the conductive housing.

2. The electronic device defined in claim 1 wherein the conductive housing comprises a metal housing wall.

3. The electronic device defined in claim 2 wherein the internal component comprises a battery.

4. The electronic device defined in claim 1 wherein the curved portions of the antenna cavity comprise a first curved portion having a first bend radius and a second curved portion having a second bend radius and wherein the first bend radius is less than the second bend radius.

5. The electronic device defined in claim 4 wherein the conductive housing comprises a metal housing wall adjacent to the cavity antenna and wherein the first curved portion of the antenna cavity is located between the metal housing wall and the second curved portion of the antenna cavity.

6. The electronic device defined in claim 4 wherein the first and second curved portions each comprise an approximately 90° bend.

7. The electronic device defined in claim 1 wherein the conductive housing comprises portions defining an opening in the conductive housing and wherein the cavity antenna is operable to transmit and receive radio-frequency signals that pass through the opening in the conductive housing.

8. The electronic device defined in claim 7 wherein the opening in the conductive housing lies in a first plane and wherein the cavity antenna comprises a planar end face that lies in a second plane that is at least parallel to the first plane.

9. The electronic device defined in claim 1 wherein the antenna resonating element comprises an inverted-F antenna probe that serves as a feed for the cavity antenna and wherein the cavity antenna comprises a dielectric support structure on which the conductive walls of the antenna cavity are formed.

10. The electronic device defined in claim 9 wherein the dielectric support structure comprises a fin on which the inverted-F antenna probe is formed.

11. The electronic device defined in claim 1 wherein the conductive housing covers at least a part of the antenna cavity.

12. An electronic device cavity antenna comprising:

an antenna resonating element coupled to a transmission line;

conductive cavity walls; and dielectric between the conductive cavity walls, wherein the dielectric has at least one curve and wherein the antenna resonating element comprises an inverted-F antenna probe.

13. The electronic device cavity antenna defined in claim 12 wherein the dielectric comprises a dielectric support structure on which the conductive cavity walls are formed.

14. The electronic device cavity antenna defined in claim 12 wherein the at least one curve comprises an approximately 90° curve.

15. The electronic device cavity antenna defined in claim 12 wherein the at least one curve comprises an approximately 180° bend.

16. An electronic device cavity antenna comprising:

an antenna resonating element coupled to a transmission line; and conductive cavity walls that define a volume, wherein the conductive cavity walls have at least one curve such that the volume has at least one curve, wherein the at least one curve of the conductive cavity walls comprises a first curve and a second curve, wherein the first and second curves are each an approximately 90° curve, wherein the first curve has a first bend radius, and wherein the second curve has a second bend radius that is greater than the first bend radius.

* * * * *